US008807718B2

(12) United States Patent
Murray

(10) Patent No.: US 8,807,718 B2
(45) Date of Patent: Aug. 19, 2014

(54) PRESSURE REGULATED INKJET PRINTHEAD WITH REPLACEABLE ON-AXIS INK TANK

(71) Applicant: Richard A. Murray, San Diego, CA (US)

(72) Inventor: Richard A. Murray, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 55 days.

(21) Appl. No.: 13/686,979

(22) Filed: Nov. 28, 2012

(65) Prior Publication Data

US 2014/0146112 A1 May 29, 2014

(51) Int. Cl.
*B41J 2/175* (2006.01)

(52) U.S. Cl.
USPC ..... 347/85; 347/43; 347/86; 347/93; 374/43

(58) Field of Classification Search
None
See application file for complete search history.

(56) References Cited

U.S. PATENT DOCUMENTS

| | | | | |
|---|---|---|---|---|
| 5,485,187 | A * | 1/1996 | Okamura et al. | 347/85 |
| 5,719,609 | A | 2/1998 | Hauck et al. | |
| 6,250,747 | B1 * | 6/2001 | Hauck | 347/86 |
| 6,685,307 | B2 * | 2/2004 | Dowell et al. | 347/85 |
| 7,350,902 | B2 | 4/2008 | Deitl et al. | |
| 2010/0201759 | A1 * | 8/2010 | Kawase et al. | 347/85 |
| 2010/0289856 | A1 * | 11/2010 | Yamamoto et al. | 347/85 |
| 2011/0310194 | A1 * | 12/2011 | Takagi | 347/86 |

* cited by examiner

*Primary Examiner* — Matthew Luu
*Assistant Examiner* — John P Zimmermann
(74) *Attorney, Agent, or Firm* — Peyton C. Watkins

(57) ABSTRACT

An inkjet printhead assembly includes: a reservoir for ink; an ink inlet for supplying ink to the reservoir; and an ink outlet disposed proximate a bottom side of the reservoir for supplying ink to a nozzle array; a first valve; a valve opening and closing mechanism for the first valve including: an inflatable bag immersed in ink and having an opening to atmosphere; and a biasing mechanism tending to force air to exit the bag; and a filter disposed in the reservoir of a printhead body, wherein the filter is tilted relative to a nozzle face; a replaceable ink tank including: an ink chamber; a vent to atmosphere; and a tank outlet disposed proximate a bottom side of the ink tank; a second valve disposed at the tank outlet; and an ink conduit for providing ink between the tank outlet and the ink inlet of the printhead body.

15 Claims, 15 Drawing Sheets

PRESSURE REGULATED INKJET PRINTHEAD WITH REPLACEABLE ON-AXIS INK TANK

FIELD OF THE INVENTION

The present invention relates generally to the field of ink supply to an inkjet printer, and more particularly to an inkjet printhead assembly having a replaceable on-axis ink tank.

BACKGROUND OF THE INVENTION

An inkjet printer typically includes one or more printheads and their corresponding ink supplies. A printhead includes an array of drop ejectors, each ejector consisting of an ink chamber, an ejecting actuator and a nozzle through which droplets of ink are ejected. The ejecting actuator may be one of various types, including a heater that vaporizes some of the ink in the chamber in order to propel a droplet out of the nozzle, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as the print medium is moved relative to the printhead.

Ink is provided to the printhead through an ink inlet of the printhead. For the case of ink supplies that are mounted on the carriage of a carriage printer, the ink supply can be permanently mounted onto the printhead, so that the printhead needs to be replaced when the ink is depleted. Alternatively an ink tank can be detachably mounted onto the printhead, so that only the ink tank itself needs to be replaced when the ink tank is depleted. Carriage mounted ink tanks (also called on-axis ink tanks) typically contain only enough ink for up to about several hundred prints. This is because the total mass of the carriage needs to be limited, so that accelerations of the carriage at each end of the travel do not result in large forces that can shake the printer back and forth.

Ink must be supplied to the printhead at a proper pressure range relative to ambient pressure. If the pressure is not sufficiently negative relative to ambient pressure, ink will tend to drool out of the printhead nozzles. If the pressure is excessively negative, the ink chambers of the drop ejectors will not fill sufficiently rapidly, leading to printing misfires and degraded image quality. Typically, a pressure regulation mechanism, such as a capillary medium, or a spring-biased bag is included in the ink tank. Such pressure regulators within the ink tank take up space that could otherwise be occupied by ink. In addition, incorporating the pressure regulator within the ink tank adds cost to the ink tank and results in more material being discarded when the ink is depleted. Finally, the pressure regulator typically retains a quantity of ink, so that when no more ink can be delivered to the printhead and the ink tank must be replaced, there is still ink remaining.

What is needed is a printhead assembly having an on-axis replaceable ink tank having a more compact, low cost design that wastes less ink and is more environmentally friendly.

SUMMARY OF THE INVENTION

An inkjet printhead assembly includes: an inkjet printhead including: a nozzle array for ejecting ink drops, the nozzle array being disposed in a nozzle face of a printhead die; a printhead body including: a reservoir for ink; an ink inlet disposed proximate a top of the reservoir for supplying ink to the reservoir; and an ink outlet disposed proximate a bottom side of the reservoir for supplying ink from the reservoir to the nozzle array; a first valve disposed proximate the ink inlet of the printhead body; a valve opening and closing mechanism for the first valve including: an inflatable bag immersed in ink in the reservoir and having an opening to atmosphere; and a biasing mechanism tending to force air to exit the bag through the opening; and a filter disposed in the reservoir of the printhead body, wherein the filter is tilted relative to the nozzle face of the printhead die; a replaceable ink tank including: an ink chamber for storing a supply of ink; a vent to atmosphere; and a tank outlet disposed proximate a bottom side of the ink tank; a second valve disposed at the tank outlet; and an ink conduit for providing ink between the tank outlet and the ink inlet of the printhead body.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
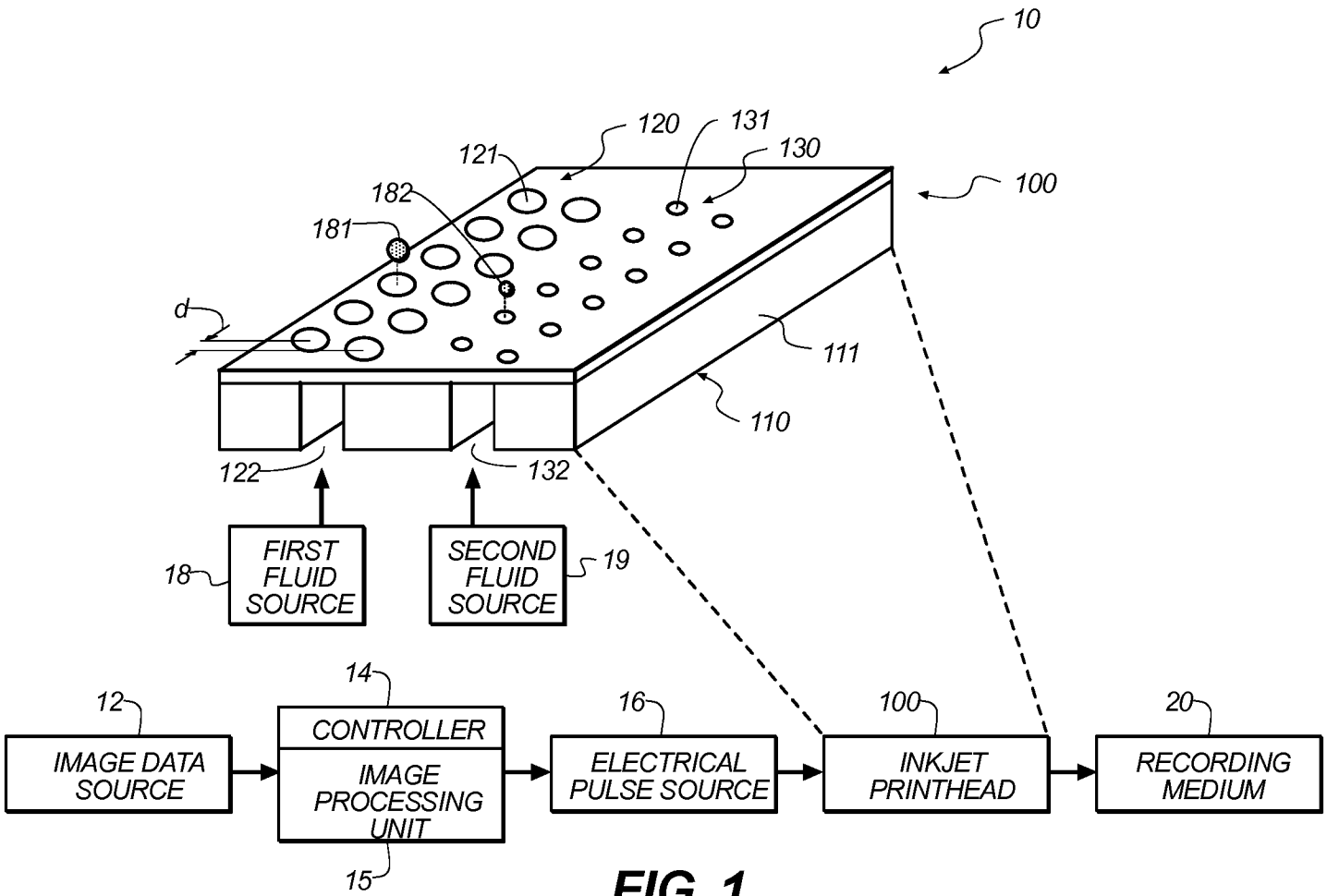
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. The controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays 120 and 130. Nozzles 121 in the first nozzle array 120 have a larger opening area than nozzles 131 in the second nozzle array 130. In this example, each of the two nozzle arrays 120, 130 has two staggered rows of nozzles 121, 131, each row having a nozzle density of 600 per inch. The effective nozzle density then in each nozzle array 120, 130 is 1200 per inch (i.e. d=1/1200 inch in FIG. 1). If pixels on a recording medium 20 were sequentially numbered along the paper advance direction, the nozzles 121, 131 from one row of the nozzle arrays 120, 130 would print the odd numbered pixels, while the nozzles 121, 131 from the other row of the nozzle arrays 120, 130 would print the even numbered pixels.

In fluid communication with each nozzle array 120, 130 is a corresponding ink delivery pathway 122, 132. The ink delivery pathway 122 is in fluid communication with the first nozzle array 120, and the ink delivery pathway 132 is in fluid communication with the second nozzle array 130. Portions of ink delivery pathways 122 and 132 are shown in FIG. 1 as openings through a printhead die substrate 111. One or more inkjet printhead die 110 will be included in the inkjet printhead 100, but for greater clarity only one inkjet printhead die 110 is shown in FIG. 1. In FIG. 1, a first fluid source 18 supplies ink to the first nozzle array 120 via the ink delivery pathway 122, and the second fluid source 19 supplies ink to the second nozzle array 130 via the ink delivery pathway 132. Although distinct first and second fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays 120, 130 can be included on the printhead die 110. In some embodiments, all nozzles 121, 131 on inkjet printhead die 110 can be the same size, rather than having multiple sized nozzles 121, 131 on the inkjet printhead die 110.

The drop forming mechanisms associated with the nozzles 121, 131 are not shown in FIG. 1. The drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from the electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with first and second nozzle arrays 120 and 130 are also sized differently in order to optimize the drop ejection process for the different sized drops. During operation, droplets 181, 182 of ink are deposited on the recording medium 20.

Figure 2:
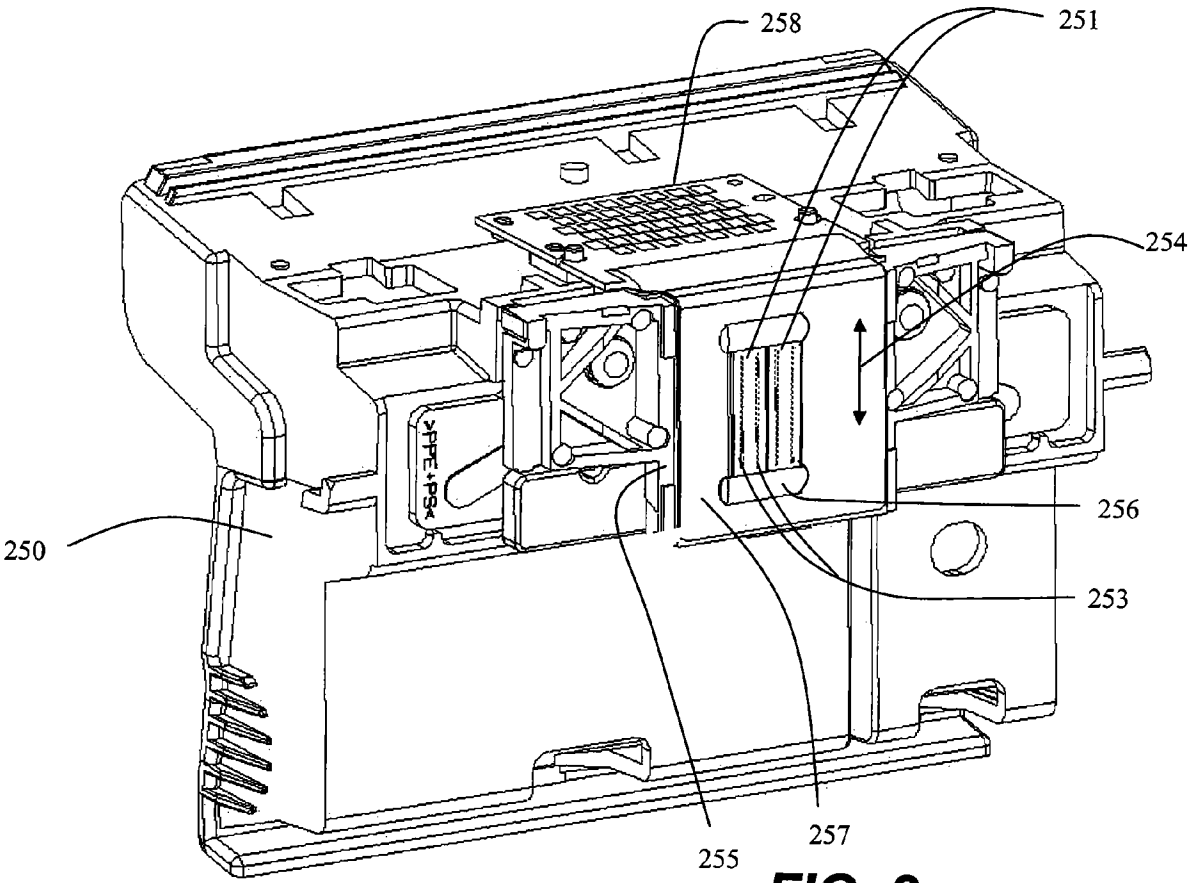
FIG. 2 is a perspective of a portion of a printhead.

FIG. 2 shows a perspective of a portion of a printhead 250, which is an example of the inkjet printhead 100. The printhead 250 includes two printhead die 251 (similar to the printhead die 110 in FIG. 1) mounted on a mounting substrate 255. Each printhead die 251 contains two nozzle arrays 253, so that the printhead 250 contains four nozzle arrays 253 altogether. The four nozzle arrays 253 in this example can each be connected to separate ink sources (not shown in FIG. 2); such as cyan, magenta, yellow, and black. Each of the four nozzle arrays 253 is disposed along a nozzle array direction 254, and the length of each nozzle array 253 along the nozzle array direction 254 is typically on the order of 1 inch or less. Typical lengths of the recording media 20 are 6 inches for photographic prints (4 inches by 6 inches) or 11 inches for paper (8.5 by 11 inches). Thus, in order to print a full image, a number of swaths are successively printed while moving the printhead 250 across the recording medium 20. Following the printing of a swath, the recording medium 20 is advanced along a media advance direction that is substantially parallel to the nozzle array direction 254.

A flex circuit 257 is electrically interconnected to the printhead die 251, for example, by wire bonding or TAB bonding. The interconnections are covered by an encapsulant 256 to protect them. The flex circuit 257 bends around the side of the printhead 250 and connects to a connector board 258. When the printhead 250 is mounted into a carriage 200 (see FIG. 3), the connector board 258 is electrically connected to a connector (not shown) on the carriage 200 so that electrical signals can be transmitted to the printhead die 251.

Figure 3:
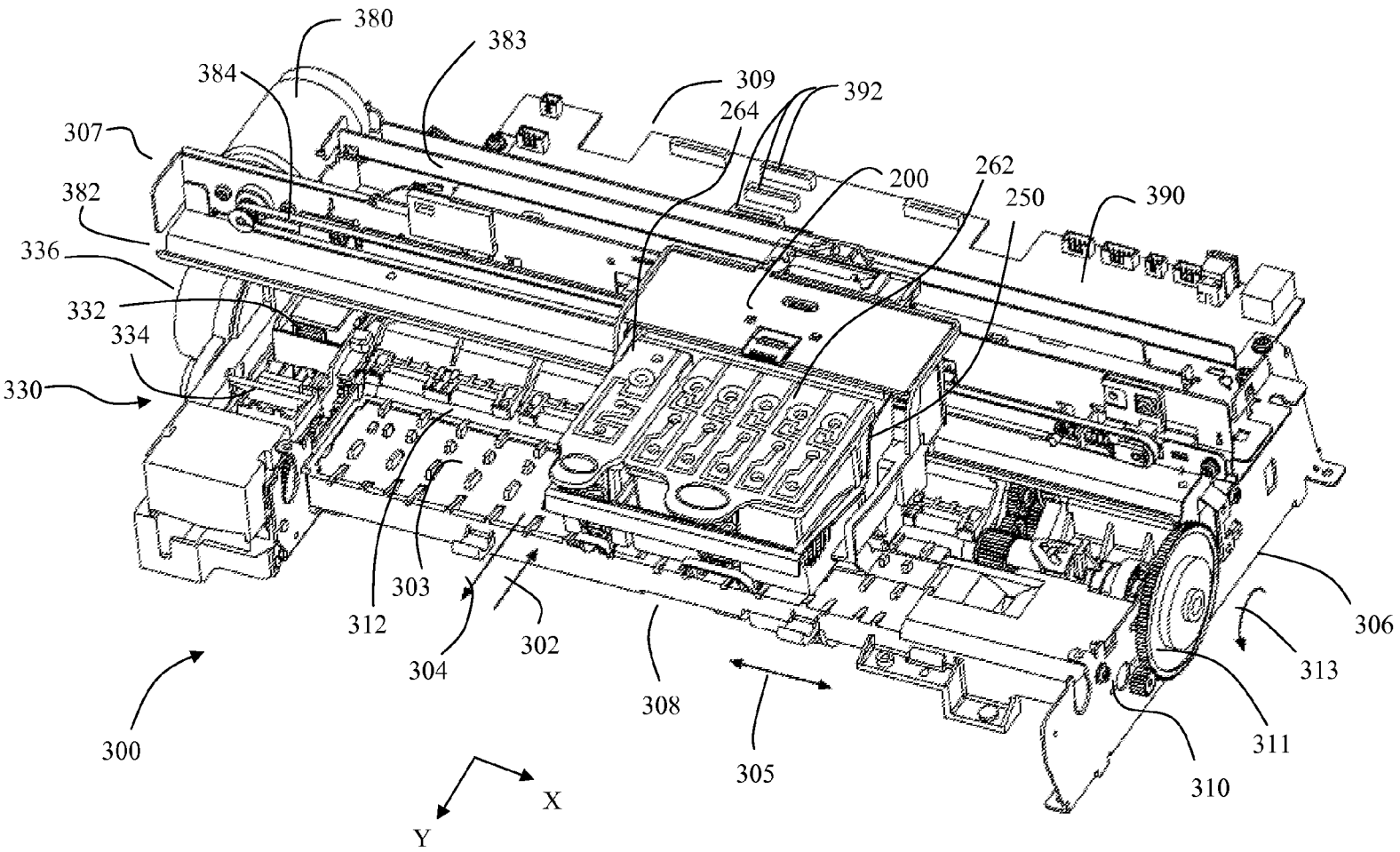
FIG. 3 is a perspective of a portion of a carriage printer.

FIG. 3 shows a portion of a desktop carriage printer that can be used in embodiments of the present invention. Some of the parts of the printer have been hidden in the view shown in FIG. 3 so that other parts can be more clearly seen. A printing mechanism 300 has a printing region 303 across which the carriage 200 is moved back and forth in a carriage scan direction 305 along the X axis, between a right side 306 and a left side 307 of the printing mechanism 300 while drops are ejected from the printhead die 251 (not shown in FIG. 3) on the printhead 250 that is mounted on the carriage 200. A carriage motor 380 moves a belt 384 to move the carriage 200 along a carriage guide member 382. The carriage guide member 382 can be a U-shaped trough as in FIG. 3. In other embodiments (not shown), the carriage guide member 382 can be a precision ground round rod. An encoder sensor (not shown) is mounted on the carriage 200 and indicates carriage location relative to an encoder fence 383.

The printhead 250 is mounted in the carriage 200, and a multi-chamber ink supply 262 and a single-chamber ink supply 264 are mounted in the printhead 250. In other words the multi-chamber ink supply 262 and the single-chamber ink supply 264 are on-axis ink tanks. The mounting orientation of the printhead 250 is rotated relative to the view in FIG. 2 so that the printhead die 251 are located at a bottom side of the printhead 250; the droplets of ink are being ejected downward onto the recording medium 20 in the printing region 303 in the view of FIG. 3. The multi-chamber ink supply 262 in the example shown in FIG. 3 contains five ink sources: cyan, magenta, yellow, photo black and a clear protective fluid, while the single-chamber ink supply 264 contains the ink source for black. In the context of the present invention, it is not important how many ink sources there are, nor whether the ink sources are all single chamber ink supplies 264 or whether some are bundled together as a multi-chamber ink supply 262. Paper or the other recording medium 20 (sometimes generically referred to as paper or media herein) is loaded along a paper load entry direction 302 toward a front of printing mechanism 308.

Figure 4:
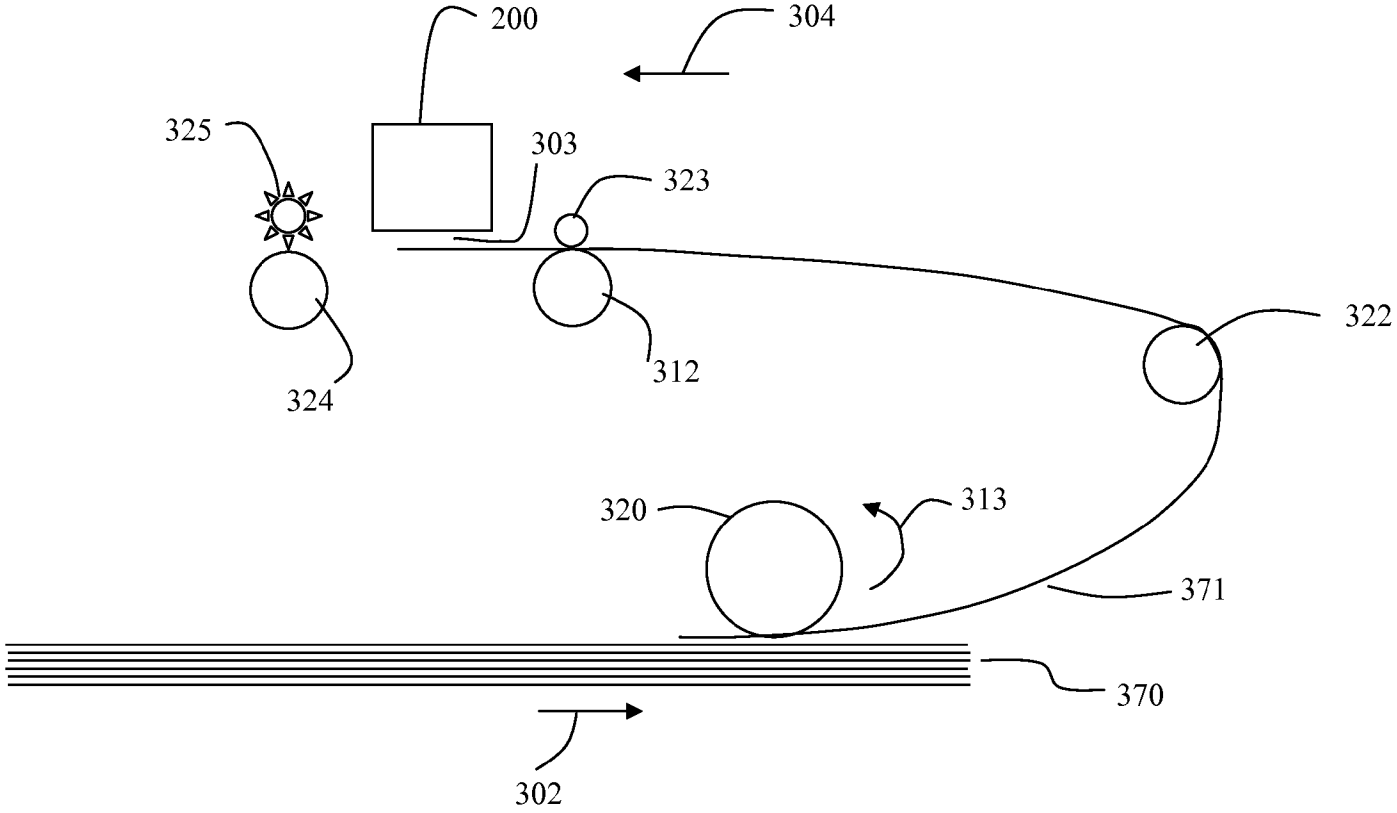
FIG. 4 is a schematic side view of an exemplary paper path in a carriage printer.

A variety of rollers are used to advance the recording medium 20 through the printer as shown schematically in the side view of FIG. 4. In this example, a pick-up roller 320 moves a top piece or sheet 371 of a stack 370 of paper or other recording medium 20 in the direction of arrow, the paper load entry direction 302. A turn roller 322 acts to move the paper around a C-shaped path (in cooperation with a curved rear wall surface) so that the paper continues to advance along the media advance direction 304 from a rear 309 of the printing mechanism (with reference also to FIG. 3). The paper or other recording medium 20 is then moved by a feed roller 312 and idler roller(s) 323 to advance along the Y axis across the printing region 303, and from there to a discharge roller 324 and star wheel(s) 325 so that printed paper or other recording medium 20 exits along the media advance direction 304 to a media output holder (not shown). The feed roller 312 includes a feed roller shaft along its axis, and a feed roller gear 311 (FIG. 3) is mounted on the feed roller shaft. The feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller 312.

The motor that powers the paper advance rollers is not shown in FIG. 3, but a hole 310 at the right side of the printing mechanism 306 is where the motor gear (not shown) protrudes through in order to engage the feed roller gear 311, as well as the gear for the discharge roller (not shown). For normal paper pick-up and feeding, it is desired that all rollers rotate in a forward rotation direction 313. Toward the left side of the printing mechanism 307, in the example of FIG. 3, is a maintenance station 330 including a cap 332 for isolating a nozzle face 252 (FIG. 5) from ambient when the inkjet printhead 250 is not printing, a wiper 334 for wiping the nozzle face 252, and a pump 336.

Toward the rear of the printing mechanism 309, in this example, is located an electronics board 390, which includes cable connectors 392 for communicating via cables (not shown) to the printhead carriage 200 and from there to the printhead 250. Also on the electronics board 390 are typically mounted motor controllers for a carriage motor 380 and for the paper advance motor, a clock for measuring elapsed time, a processor and other control electronics (shown schematically as controller 14 and image processing unit 15 in FIG. 1) for controlling the printing process, and an optional connector for a cable to a host computer.

Figure 5:
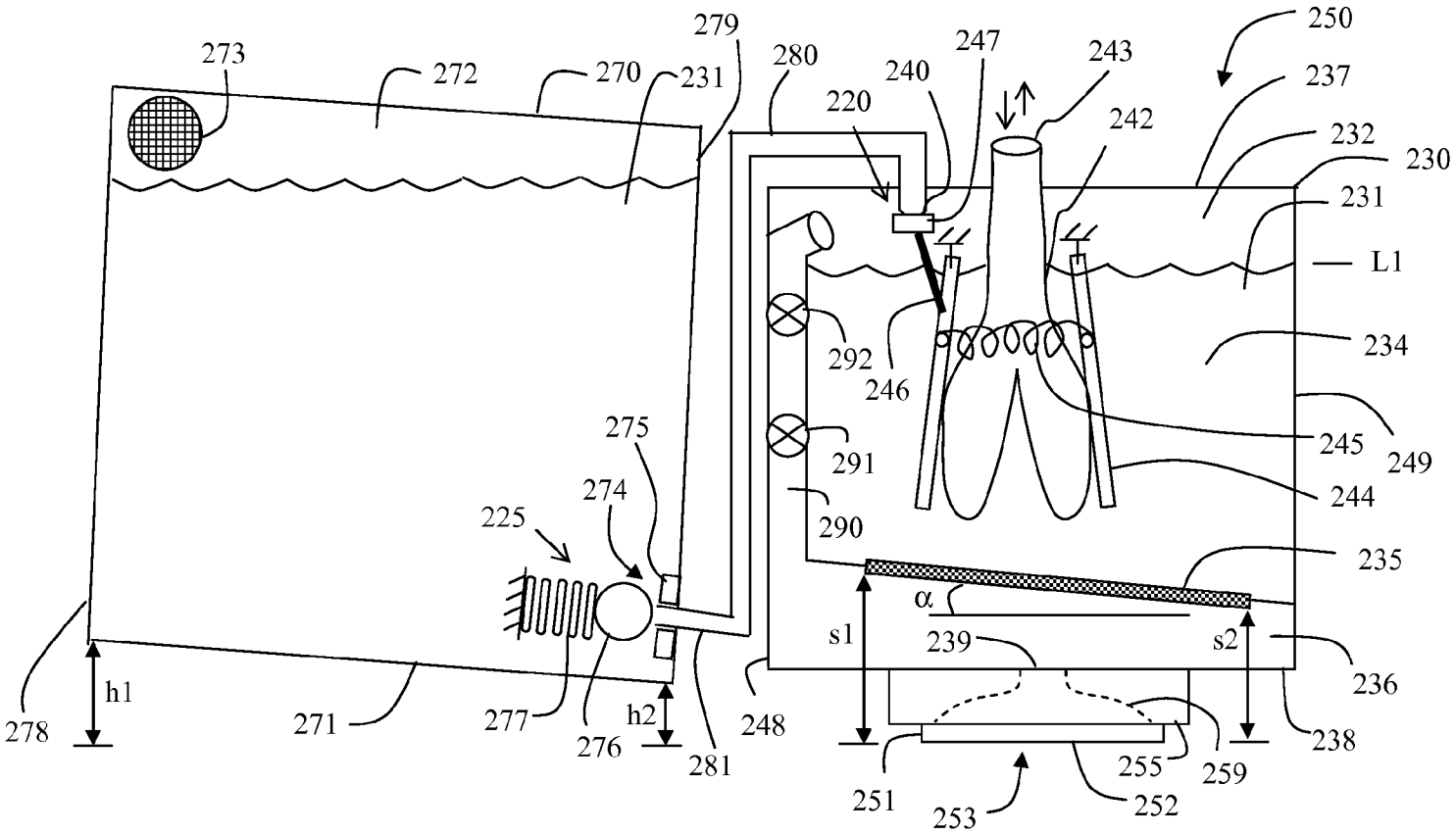
FIG. 5 schematically shows an inkjet printhead assembly including an inkjet printhead and a replaceable ink tank according to an embodiment of the invention.

FIG. 5 schematically shows an inkjet printhead assembly including the inkjet printhead 250 and an on-axis replaceable ink tank 270 having an ink chamber 272 for storing a supply of ink 231 according to an embodiment of the present invention. Because the flow of ink 231 and air are assisted by gravity and buoyancy respectively, words such as "top" and "bottom" will be used herein. It is understood that the top is above the bottom when the inkjet printhead assembly is in its normal operating orientation. The inkjet printhead 250 includes a printhead body 230 including a reservoir 232 for the ink 231. An ink inlet 240 is provided near a top 237 of the reservoir 232 for supplying ink 231 to a reservoir 232. An ink outlet 239 is provided at or near a bottom side 238 of the reservoir 232 for supplying ink 231 from the reservoir 232 to the nozzle array 253. The nozzle array 253 is disposed in the nozzle face 252 of the printhead die 251 that is mounted to the mounting substrate 255. The substrate ink passageway 259 is provided in the mounting substrate 255 and is fluidically connected to both the ink outlet 239 and nozzle array 253 so that ink 231 is provided to the nozzle array 253 for ejecting ink drops.

Figure 6:
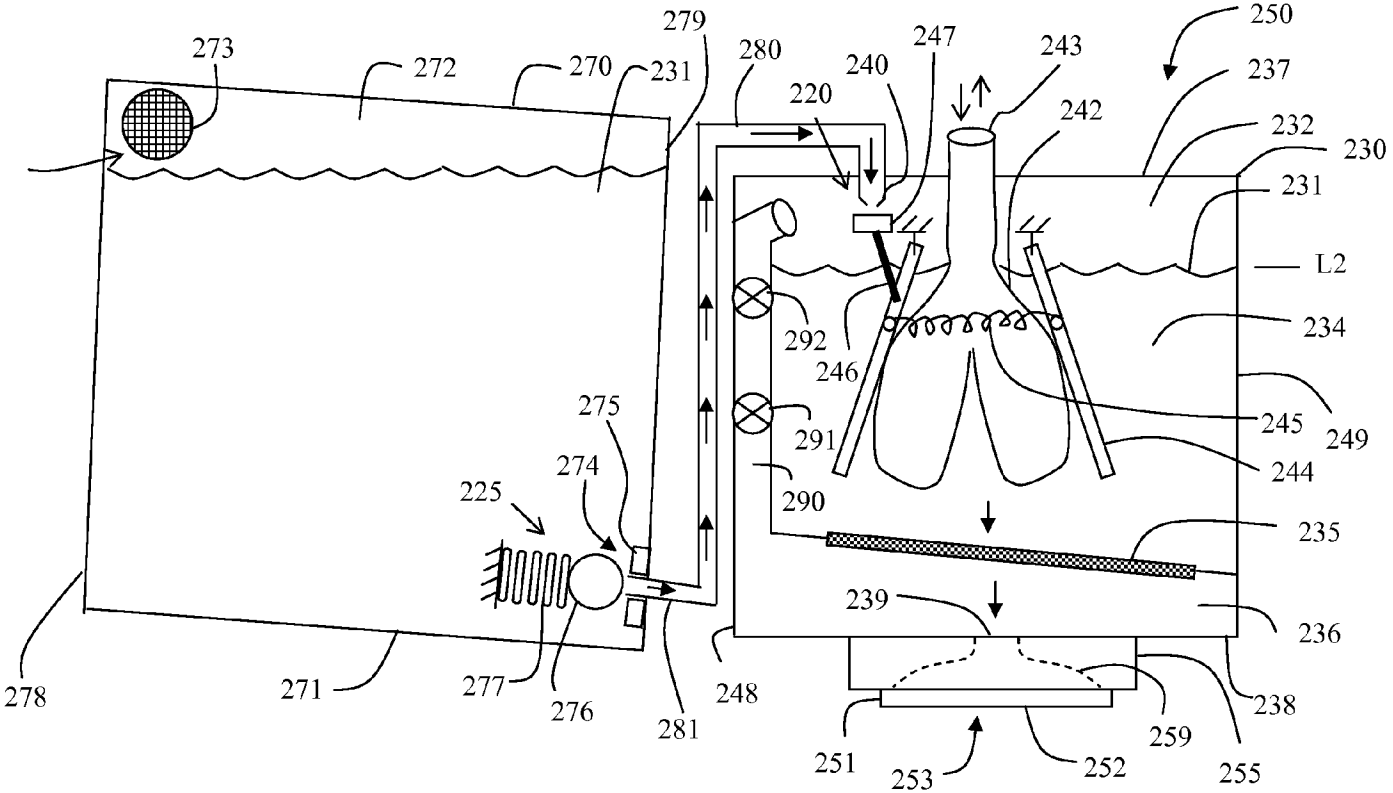
FIG. 6 shows the embodiment of FIG. 5 with a valve open so that ink can flow from the replaceable ink tank to the inkjet printhead.

A first valve 220 including a valve plug 247 that closes the ink inlet 240 by seating against a face of the ink inlet 240 is provided near the ink inlet 240. A valve opening and closing mechanism includes an inflatable bag 242 that is immersed in the ink 231. The valve opening and closing mechanism is similar to the one described in U.S. Pat. No. 5,719,609, which is incorporated herein by reference. The inflatable bag 242 has an opening 243 that is open to atmosphere. Air can enter or exit the inflatable bag 242 as indicated by the arrows of opposite direction near the opening 243. A biasing mechanism is provided that tends to force air to exit the inflatable bag 242 through the opening 243. In the example shown in FIGS. 5 and 6, the biasing mechanism includes a pair of flaps 244 that are joined by an extension spring 245 and press against the inflatable bag 242. A linkage 246 is connected between a valve plug 247 and one of the flaps 244. In FIG. 5, the ink 231 is present in the reservoir 232 up to a level L1. The flaps 244 compress the inflatable bag 242 somewhat and linkage 246 pushes the valve plug 247 against a face of the ink inlet 240 so that ink 231 cannot enter the reservoir 232. As the ink 231 in the reservoir 232 is used by ejecting ink drops from the nozzle array 253, the ink 231 decreases to a level L2 as shown in FIG. 6. As a result, the pressure within the reservoir 232 tends to decrease so that the air pressure in the inflatable bag 242 drops relative to atmospheric pressure so that air is forced into the inflatable bag 242, which makes it expand. As inflatable bag 242 expands, it pushes the flaps 244 outward against the biasing force of the extension spring 245. This causes the linkage 246 to pull the valve plug 247 away from the ink inlet 240. Because of the reduced pressure within the reservoir 232, the ink 231 is pulled through a conduit 280 between a tank outlet 274 of the replaceable ink tank 270 and the ink inlet 240 as indicated by the arrows in a conduit 280 in FIG. 6. A vent 273 to atmosphere is provided in the replaceable ink tank 270 so that as ink 231 is transferred out of the replaceable ink tank 270, air can enter through the vent 273 as indicated by the arrow near vent 273 in FIG. 6. In some embodiments, the vent 273 includes a semi-permeable membrane that allows the passage of air, but does not allow the passage of ink.

When sufficient ink 231 has been transferred from the replaceable ink tank 270 into the reservoir 232, the pressure in the reservoir 232 increases such that the spring-biased flaps 244 can again partially deflate inflatable bag 242 and the valve plug 247 again seats against the face of the ink inlet 240 as in FIG. 5. The inflatable bag 242 and the extension spring 245 not only provide a valve opening and closing mechanism, but also provide pressure regulation. For proper operation of the nozzle array 253, it is preferable that ink pressure at the nozzle array 253 be 0 to 10 inches of water below atmospheric pressure. The replaceable ink tank 270 can be on the order of 4 inches tall, so the ink pressure within the ink chamber 272 of the replaceable ink tank 270 can range from about 0 to a positive pressure of about 4 inches of water relative to the nozzle array 253. The inflatable bag 242, extension spring 245 and linkage 247 are configured to provide a satisfactory range of ink pressure at the nozzle array 253.

The tank outlet 274 is disposed near a bottom side 271 of the replaceable ink tank 270. So that ink 231 does not flow out of the replaceable ink tank 270 when the replaceable ink tank 270 is not installed, a second valve 225 is provided at the tank outlet 274. In the example shown in FIGS. 5 and 6, the second valve 225 includes a valve seat 275, a ball 276 and a compression spring 277. When the replaceable ink tank 270 is not installed, the compression spring 277 pushes the ball 276 against the valve seat 275 so that the tank outlet 274 is sealed shut. When the replaceable ink tank 270 is installed on the inkjet printhead 250, a conduit inlet 281 enters the tank outlet 274 and pushes the ball 276 away from the valve seat 275 so that ink can flow into the conduit inlet 281. The ink chamber 272 of the replaceable ink tank 270 has a first side 278 extending from a bottom side 271 and a second side 279 opposite the first side 278. When the replaceable ink tank 270 is installed on the inkjet printhead 250, the second side 279 is located near a printhead body 230, and the first side 278 is located farther away from printhead body 230. In the example shown in FIGS. 5 and 6, the tank outlet 274 is located on the second side 279 near the bottom side 271. In other embodiments of the present invention, the tank outlet 274 can be located on the bottom side 271. In any case, it is preferable for the tank outlet 274 to be located proximate the bottom side 271 of the replaceable ink tank 270 so that more of the ink 231 in the ink chamber 272 can be transferred to the inkjet printhead 250 and less ink 231 is stranded and wasted. For configurations where the tank outlet is located on second side 279 (as in FIGS. 5 and 6), it is advantageous for a bottom of the first side 278 of the ink chamber 272 to be located at a first height h1 above a plane of the nozzle face 252 and a bottom of the second side 279 of the ink chamber 272 to be located at a second height h2 above the plane of the nozzle face 252, where h1 is greater than h2. This allows the ink 231 to drain more completely from the ink chamber 272 through the tank outlet 275. The conduit inlet 281 can also slope upward as shown in FIGS. 5 and 6 to allow easier installation of the tilted replaceable ink tank 270.

Figure 7:
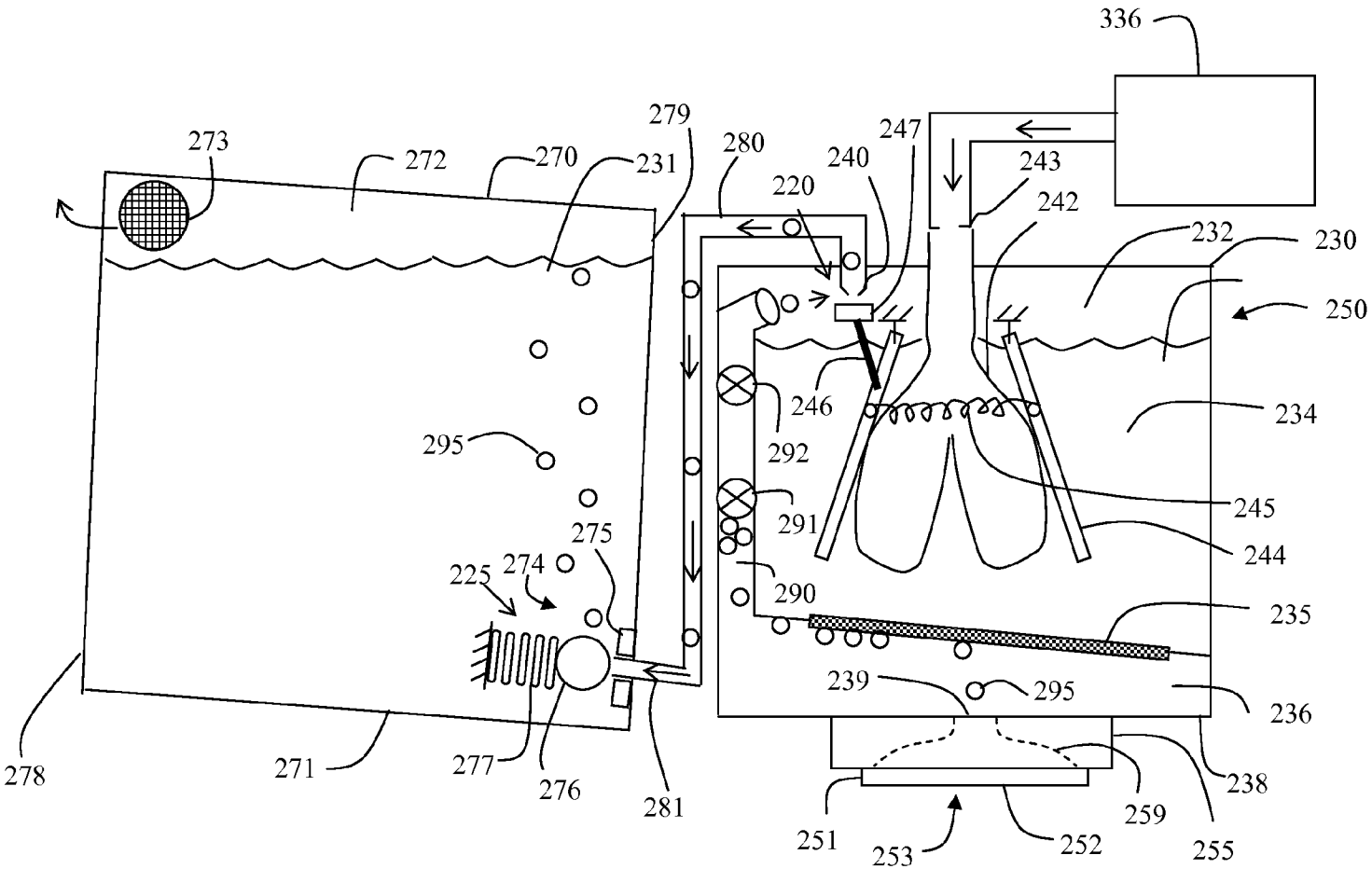
FIG. 7 shows the embodiment of FIG. 5 with air bubbles being forced from inkjet printhead into the replaceable ink tank and out through a vent.

Also tilted relative to the plane of the nozzle face 252 (but for a different reason) is filter 235 that is disposed in the reservoir 232 of printhead body 230. Printhead body includes a first side 248 extending from the bottom side 238 of reservoir 232 and a second side 249 opposite first side 248. When the replaceable ink tank 270 is installed on the printhead 250, the first side 248 of the printhead body 230 is next to the second side 279 of the replaceable ink tank 270. As shown in FIG. 5, an end of filter 235 near the first side 248 of the printhead body 230 is located a first distance s1 from the nozzle face 252 of the printhead die 251, and an end of the filter 235 near the second side 249 of the printhead body 230 is located a second distance s2 from the nozzle face 252 of the printhead die 251, such that s1 is greater than s2. The filter 235 separates the reservoir 232 into an upper reservoir portion 234 and a lower reservoir portion 236. Ink 231 can pass from an upper reservoir portion 234 to a lower reservoir portion 236 through the filter 235 as indicated by the arrows near filter 235 in FIG. 6. However, air bubbles 295 (see FIG. 7) that enter the lower reservoir portion 236 from the printhead die 251, for example, rise up to the filter 235 due to buoyancy but cannot pass through the filter 235. Tilting of the filter 235 helps the air bubbles 295 to continue to move upward along the filter 235 until they reach a passageway 290 that is fluidically connected between the lower reservoir portion 236 and the ink conduit 280. Tilt angle $\alpha$ (FIG. 5) between a plane of the filter 235 and the plane of the nozzle face 252 of the printhead die 251 is preferably between three degrees and twenty degrees. For angles less than about three degrees, the air bubbles 295 do not tend to move as well along the filter 235 toward the passageway 290. For angles greater than about twenty degrees, the filter 235 takes up too much height in the printhead body 230.

Preferably at least one one-way valve, such as a flap valve or a duckbill valve is provided in the passageway 290. In the example shown in FIGS. 5-7, a first one-way valve 291 is disposed in the passageway 290 near the filter 235, and a second one-way valve 292 is disposed in the passageway 290 farther away from the filter 235. Both the first one-way valve 291 and the second one-way valve 292 are configured to permit air to move from the lower reservoir portion 236 to the ink conduit 280, but not to permit ink 231 to move from the ink conduit 280 to the lower reservoir portion 236. It is not desirable for ink 231 to move directly from the ink conduit 280 to the lower reservoir portion 236 because that would bypass the filter 235 and allow particulates to enter the ink outlet 239, move through the substrate ink passageway 259 and obstruct the nozzle array 253. In some embodiments only one one-way valve 291 is present. Having both the first one-way valve 291 and the second one-way valve 292 in the passageway 290 can provide greater protection against particulates moving to the lower ink reservoir 236.

Air bubbles 295 are moved past the first one-way valve 291 (and second one-way valve 292 if present) in the ink passageway 290 when a pressure differential in the ink passageway 290 below the first one-way valve 291 relative to a pressure in the ink conduit 280 exceeds a cracking pressure of the valve. For example, if a pressure source as can be provided by pump 336 for example provides sufficient positive air pressure into the opening of an inflatable air bag 242, the inflatable bag 242 expands, thereby increasing the pressure within the reservoir 232 and moving a valve plug 247 away from the ink inlet 240. As a result, the air bubbles 295 are moved past the first one-way valve 291 and the second one-way valve 292 and into the conduit 280. From the conduit 280, the air bubbles 295 move into the replaceable ink tank 270 via the tank outlet 274 and then exit replaceable ink tank 270 through the vent 273 as indicated by the arrow near the vent 273 in FIG. 7. The pressure source can be disposed near the maintenance station 330 (FIG. 3), and can be operated by a pump 336 (FIG. 3).

Figure 8:
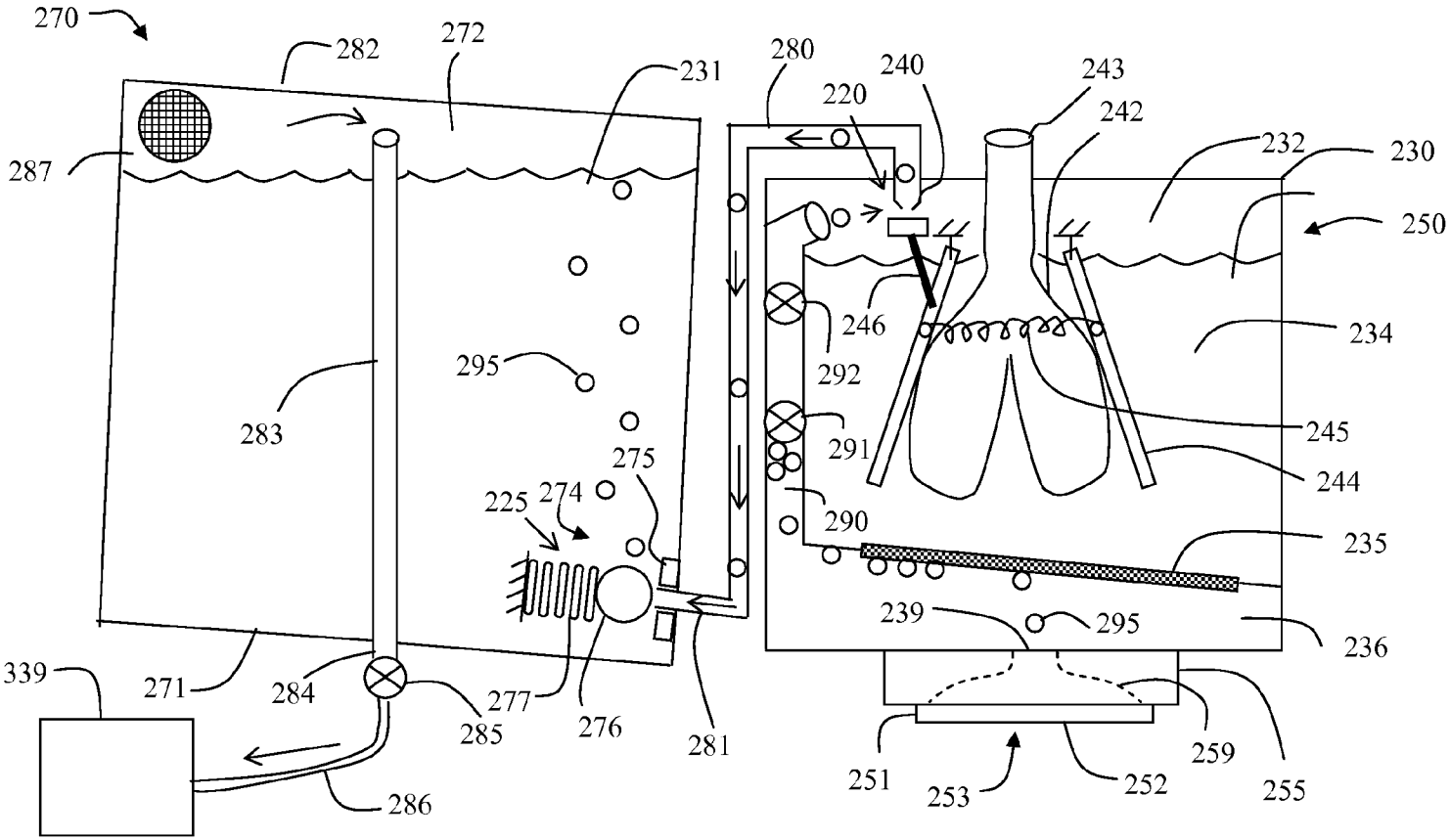
FIG. 8 shows an alternative embodiment to FIG. 7 where the air bubbles are suctioned out from the replaceable ink tank.

In an alternate embodiment shown in FIG. 8, a pipe 283 extends from the bottom side 271 of the ink chamber 272 toward a top side 282 that is opposite the bottom side 271. A third valve 285 is disposed near an end 284 of the pipe 282 that is near the bottom side 271 of the ink chamber 272. The third valve 285 can include a spring-biased ball (not shown) similar to the second valve 225 that is at the tank outlet 274. When a tubing 286 is inserted into third valve 285, it opens the third valve 285. The tubing 286 is connected to a suction source 339. When the suction source 339 is turned on, air is sucked from an air space 287 above ink 231 in the ink chamber 272, thereby reducing pressure so that the air bubbles 295 are pulled past the first one-way valve 291 and the second one-way valve 292 and into the ink conduit 280. From the conduit 280, the air bubbles 295 move into the replaceable ink tank 270 via tank outlet 275 and then exit replaceable ink tank 270 through the pipe 283 and the third valve 285. The suction source 339 can be disposed near the maintenance station 330 (FIG. 3), and can be operated by the pump 336 (FIG. 3).

Figure 9:
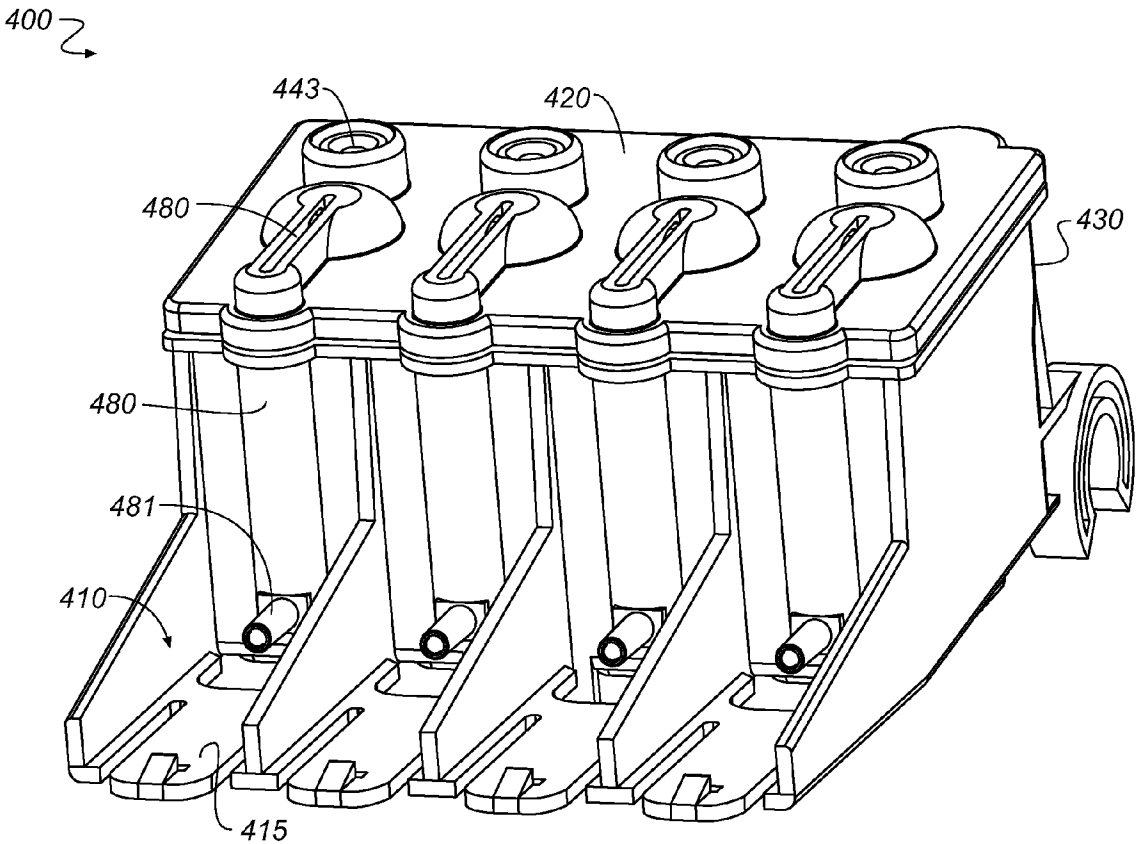
FIG. 9 is a front perspective of an inkjet printhead according to an embodiment of the invention.
Figure 10:
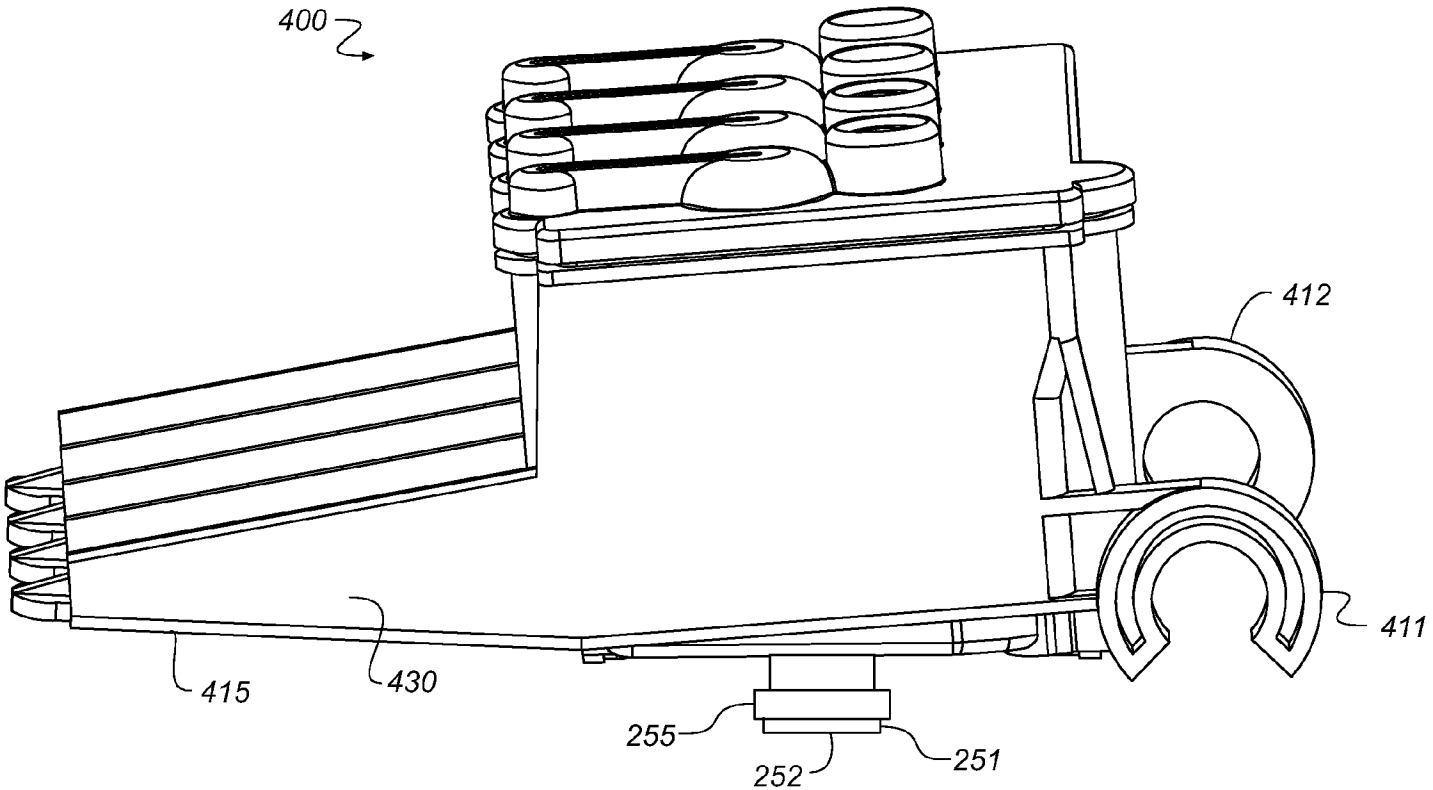
FIG. 10 is a side perspective of the inkjet printhead of FIG. 9.

FIGS. 9-15 show perspectives of portions of an inkjet printhead 400 according to an embodiment of the present invention with features similar to those described above relative to FIGS. 5-8. The inkjet printhead 400 has a printhead body 430 covered by a lid 420. Extending from the printhead body 430 are four holding receptacles 410 for replaceable ink tanks (not shown). As seen in FIGS. 9 and 10, a floor 415 of the holding receptacles 410 is sloped relative to the nozzle face 252 of the printhead die 251 so that ink (not shown) can drain more completely into the conduit inlet 281 as described above with reference to FIGS. 5 and 6. In the embodiment shown in FIG. 9, the ink conduit 480 is incorporated into the printhead body 430 and the lid 420. The conduit inlet 481 extends into the holding receptacle 410. An opening 443 to permit air to enter the inflatable bag 442 (FIG. 14) is provided through the lid 420.

Figure 11:
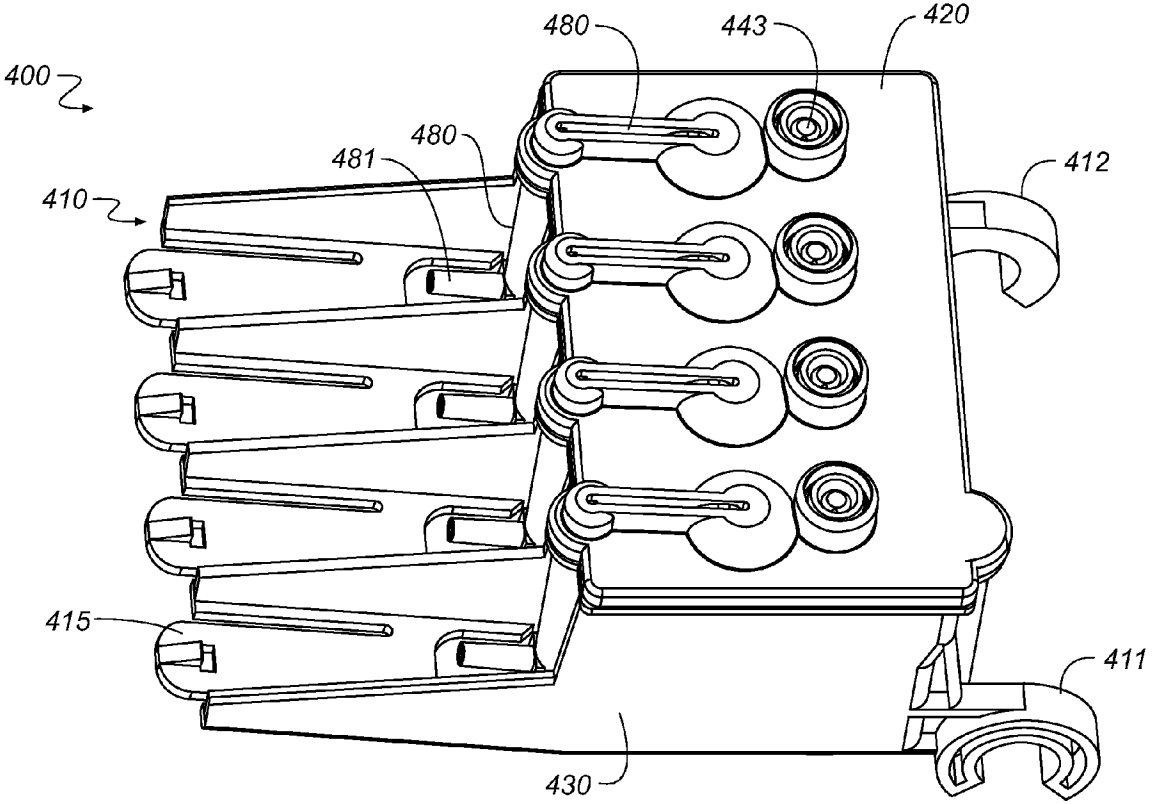
FIG. 11 is a top perspective of the inkjet printhead of FIG. 9.

As shown in the side perspective of FIG. 10 and the top perspective of FIG. 11, the printhead body 430 includes a first guide retainer 411 and a second guide retainer 412 in line with the first guide retainer 411. The first guide retainer 411 and the second guide retainer 412 are for guiding the inkjet printhead 400 along the carriage guide member 382 (FIG. 3) as the inkjet printhead assembly moves back and forth across the printing region 303 (FIG. 3). In other words, the inkjet printhead 400 does not require a separate carriage 200 (FIG. 3), but has the guide features incorporated in it. The first guide retainer 411 and the second guide retainer 412 are shaped to fit the carriage guide member 382 that is shaped as a round rod. The carriage motor 380 (FIG. 3) moves the inkjet printhead 400 and the on-axis replaceable ink tanks 270 (FIG. 5) across the printing region 303.

Figure 12:
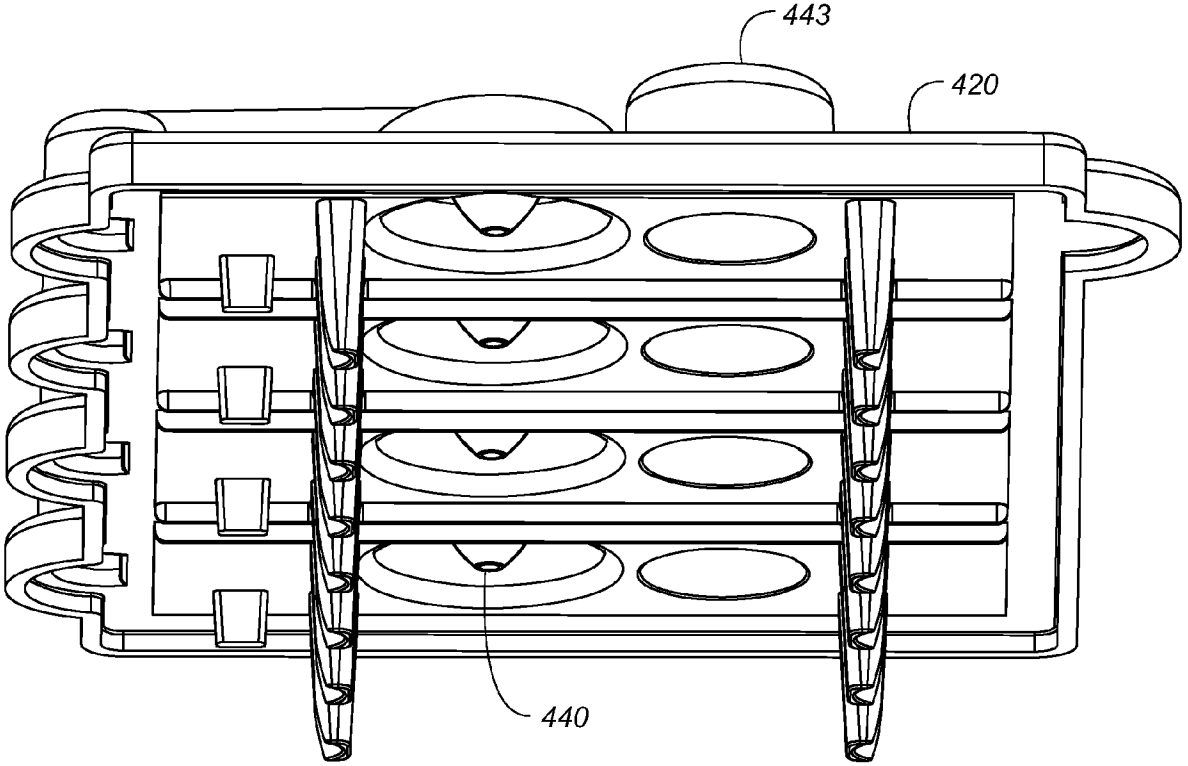
FIG. 12 is an underside perspective of a lid of the inkjet printhead of FIG. 9.
Figure 13:
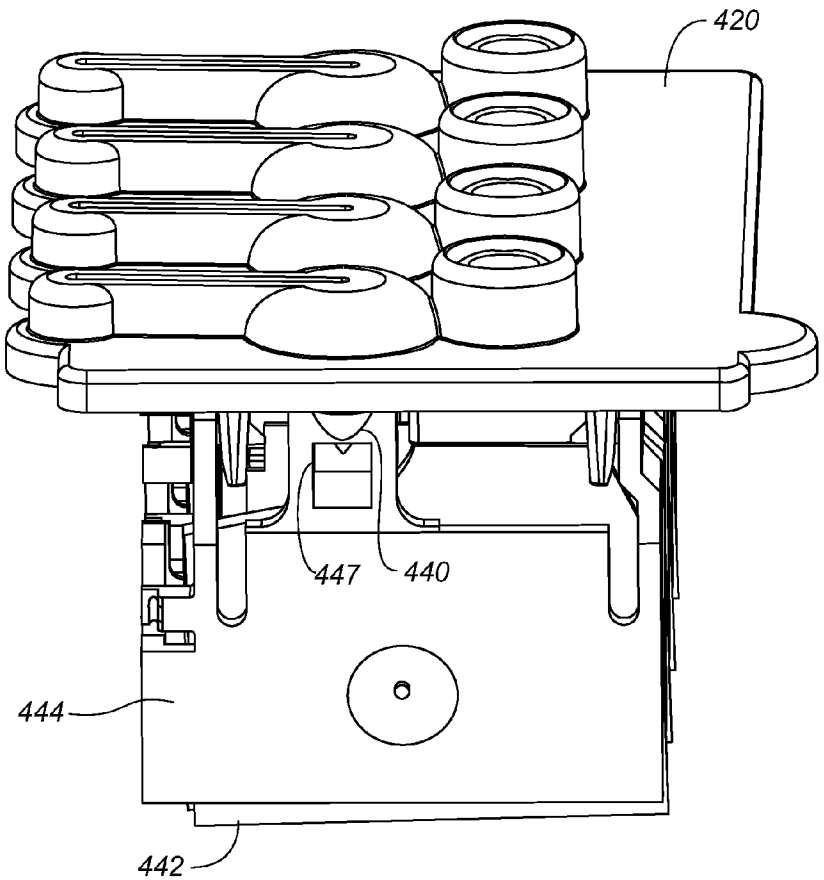
FIG. 13 is a side perspective of the lid of FIG. 12 plus members of a valve opening and closing mechanism according to an embodiment of the invention.
Figure 14:
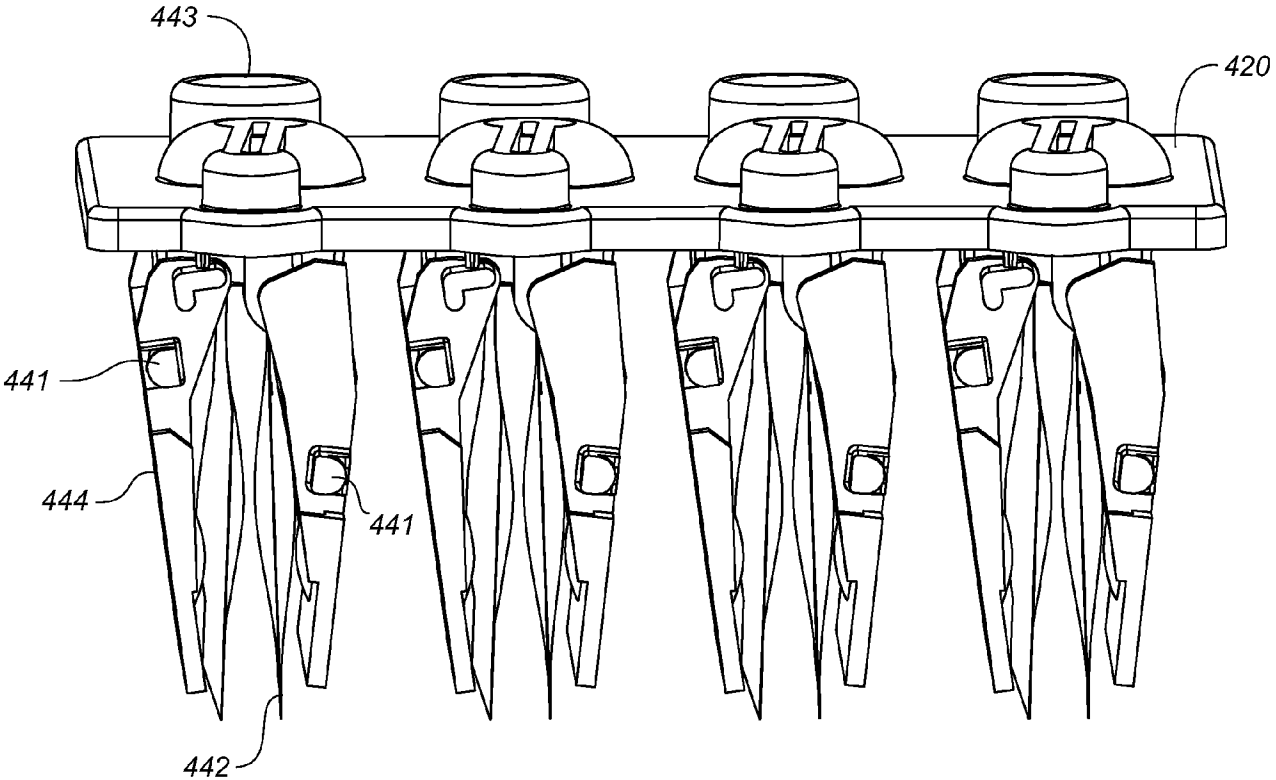
FIG. 14 is a front perspective of the lid and valve opening and closing mechanism of FIG. 13.
Figure 15:
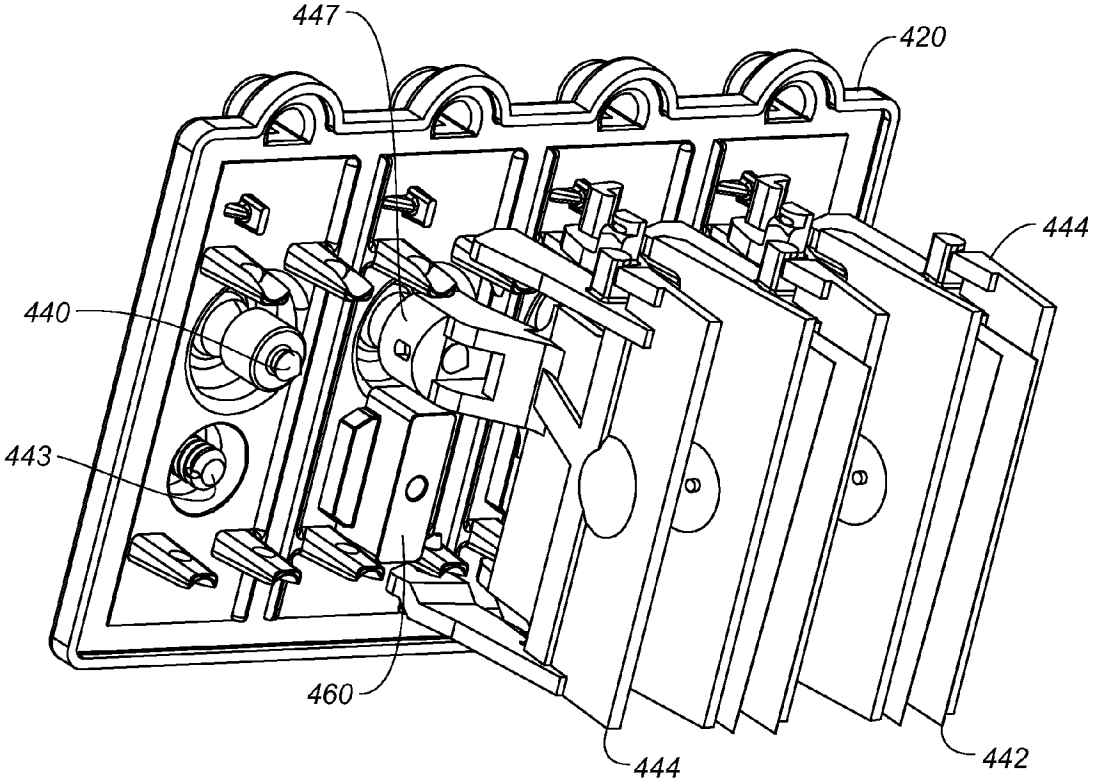
FIG. 15 is an underside perspective of the lid and valve opening and closing mechanism of FIG. 13.

FIG. 12 shows an underside perspective of the lid 420 including the opening 443 for the inflatable bag 442 (FIG. 14) and the ink inlet 440. FIG. 13 shows a side perspective of the lid 420 including the ink inlet 440. Also shown in FIG. 13 is the inflatable bag 442, the flap 444, and the valve plug 447, which have similar functions to correspondingly numbered and named items in FIGS. 5-8. FIG. 14 shows a front perspective of the lid 420 with four sets of the inflatable bags 442 and the flaps 444. Spring attachments 441 are shown on the flaps 444 for attaching extension springs 245 (FIG. 5). FIG. 15 shows an underside perspective of the lid 420 with some flaps 444 and inflatable bags 442 visible and others hidden to reveal other features. Both the inflatable bags 442 and the pairs of flaps 444 are shown for the two sets closest to the right hand side of the lid 420. For the set that is second from the left, the inflatable bag 442 and one flap 444 are hidden in order to show the valve plug 447 and a bag fitment 460 for attaching the inflatable bag 442 to the lid 420. For the leftmost set, the inflatable bag 442, both flaps 444 and the bag fitment 460 are hidden in order to show the opening 443 and the ink inlet 440.

The present invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
220 First valve
225 Second valve
230 Printhead body
231 Ink
232 Reservoir
234 Upper reservoir portion
235 Filter
236 Lower reservoir portion
237 Top (of the reservoir)
238 Bottom side (of the reservoir)
239 Ink outlet
240 Ink inlet
242 Inflatable bag
243 Opening
244 Flap(s)
245 Extension spring
246 Linkage
247 Valve plug
248 First side (of printhead body)
249 Second side (of printhead body)
250 Printhead
251 Printhead die
252 Nozzle face
253 Nozzle array
254 Nozzle array direction
255 Mounting substrate
256 Encapsulant
257 Flex circuit
258 Connector board
259 Substrate ink passageway
262 Multi-chamber ink supply
264 Single-chamber ink supply
270 Replaceable ink tank
271 Bottom side (of ink tank)
272 Ink chamber
273 Vent
274 Tank outlet
275 Valve seat
276 Ball
277 Compression spring
278 First side (of ink chamber)
279 Second side (of ink chamber)
280 Conduit
281 Conduit inlet
282 Top side (of ink tank)
283 Pipe
284 End (of pipe)
285 Third valve
286 Tubing
287 Air space
290 Passageway
291 First one-way valve
292 Second one-way valve
295 Air bubbles
300 Printing mechanism
302 Paper load entry direction
303 Printing region
304 Media advance direction
305 Carriage scan direction
306 Right side of printing mechanism
307 Left side of printing mechanism
308 Front of printing mechanism
309 Rear of printing mechanism
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
332 Cap
334 Wiper
336 Pump
339 Suction source
370 Stack of media
371 Sheet
380 Carriage motor
382 Carriage guide member

383 Encoder fence
384 Belt
390 Printer electronics board
392 Cable connectors
400 Inkjet printhead
410 Holding receptacle(s)
411 First guide retainer
412 Second guide retainer
415 Floor
420 Lid
430 Printhead body
440 Ink inlet
441 Spring attachments
442 Inflatable bag
443 Opening
444 Flap(s)
447 Valve plug
460 Bag fitment
480 Ink conduit
481 Conduit inlet
L1 Level 1
L2 Level 2
s1 First distance
s2 Second distance
h1 First height
h2 Second height
α tilt angle

The invention claimed is:

1. An inkjet printhead assembly comprising:
an inkjet printhead including:
a nozzle array for ejecting ink drops, the nozzle array being disposed in a nozzle face of a printhead die;
a printhead body including:
a reservoir for ink;
an ink inlet disposed proximate a top of the reservoir for supplying ink to the reservoir; and
an ink outlet disposed proximate a bottom side of the reservoir for supplying ink from the reservoir to the nozzle array;
a first valve disposed proximate the ink inlet of the printhead body;
a valve opening and closing mechanism for the first valve including:
an inflatable bag immersed in ink in the reservoir and having an opening to atmosphere; and
a biasing mechanism tending to force air to exit the bag through the opening; and
a filter disposed in the reservoir of the printhead body, wherein the filter is tilted relative to the nozzle face of the printhead die;
a replaceable ink tank including:
an ink chamber for storing a supply of ink;
a vent to atmosphere; and
a tank outlet disposed proximate a bottom side of the ink tank;
a second valve disposed at the tank outlet;
and
an ink conduit for providing ink between the tank outlet and the ink inlet of the printhead body;
wherein the ink chamber of the replaceable ink tank further includes: a first side extending from the bottom side of the ink tank, and a second side opposite the first side, wherein the second side is disposed proximate the printhead body, and wherein the tank outlet is disposed on the second side;
wherein the printhead body further includes: a first side extending from the bottom side of the reservoir, wherein the first side of the printhead body is disposed proximate the second side of the replaceable ink tank; and a second side opposite the first side
wherein an end of the filter disposed proximate the first side of the printhead body is located a first distance from the nozzle face of the printhead die, an end of the filter disposed proximate the second side of the printhead body is located a second distance from the nozzle face of the printhead die, and the first distance is greater than the second distance.

2. The inkjet printhead assembly of claim 1, wherein the replaceable ink tank further includes a pipe extending from the bottom side of the ink chamber toward a top side that is opposite the bottom side.

3. An inkjet printhead assembly comprising:
an inkjet printhead including:
a nozzle array for ejecting ink drops, the nozzle array being disposed in a nozzle face of a printhead die;
a printhead body including:
a reservoir for ink;
an ink inlet disposed proximate a top of the reservoir for supplying ink to the reservoir; and
an ink outlet disposed proximate a bottom side of the reservoir for supplying ink from the reservoir to the nozzle array;
a first valve disposed proximate the ink inlet of the printhead body;
a valve opening and closing mechanism for the first valve including:
an inflatable bag immersed in ink in the reservoir and having an opening to atmosphere; and
a biasing mechanism tending to force air to exit the bag through the opening; and
a filter disposed in the reservoir of the printhead body, wherein the filter is tilted relative to the nozzle face of the printhead die;
a replaceable ink tank including:
an ink chamber for storing a supply of ink;
a vent to atmosphere; and
a tank outlet disposed proximate a bottom side of the ink tank;
a second valve disposed at the tank outlet;
and
an ink conduit for providing ink between the tank outlet and the ink inlet of the printhead body;
wherein the ink chamber of the replaceable ink tank further includes: a first side extending from the bottom side of the ink tank, and a second side opposite the first side, wherein the second side is disposed proximate the printhead body, and wherein the tank outlet is disposed on the second side;
wherein the replaceable ink tank further includes a pipe extending from the bottom side of the ink chamber toward a top side that is opposite the bottom side;
wherein the replaceable ink tank further includes a third valve disposed near an end of the pipe proximate the bottom side of the ink chamber.

4. The inkjet printhead assembly of claim 1, wherein a bottom of the first side of the ink chamber is located at a first height above a plane of the nozzle face, a bottom of the second side of the ink chamber is located at a second height above the plane of the nozzle face, and the first height is greater than the second height.

5. The inkjet printhead assembly of claim 3, wherein the printhead body further includes:

a first side extending from the bottom side of the reservoir, wherein the first side of the printhead body is disposed proximate the second side of the replaceable ink tank; and a second side opposite the first side.

6. The inkjet printhead assembly of claim 5, wherein an end of the filter disposed proximate the first side of the printhead body is located a first distance from the nozzle face of the printhead die, an end of the filter disposed proximate the second side of the printhead body is located a second distance from the nozzle face of the printhead die, and the first distance is greater than the second distance.

7. The inkjet printhead assembly of claim 1, the printhead body further comprising:

an upper reservoir portion and a lower reservoir portion that are separated by the filter; and a passageway that is fluidically connected between the lower reservoir portion and the ink conduit, wherein at least one one-way valve is disposed in the passageway for permitting air to move from the lower reservoir portion to the ink conduit.

8. The inkjet printhead assembly of claim 7, wherein the at least one one-way valve includes a first one way valve disposed proximate the filter, and a second one-way valve disposed distal to the filter.

9. The inkjet printhead assembly of claim 1, wherein the vent of the replaceable ink tank includes a semi-permeable membrane.

10. The inkjet printhead assembly of claim 1, wherein a tilt angle between a plane of the filter and a plane of the nozzle face of the printhead die is between 3 degrees and 20 degrees.

11. The inkjet printhead assembly of claim 1, wherein the printhead body further includes a first guide retainer and a second guide retainer in line with the first guide retainer for guiding the inkjet printhead along a guide member as the inkjet printhead assembly moves back and forth in an inkjet printer.

12. An inkjet printer comprising:

an inkjet printhead assembly comprising:

an inkjet printhead including:

a nozzle array for ejecting ink drops, the nozzle array being disposed in a nozzle face of a printhead die;

a printhead body including:

a reservoir for ink;

an ink inlet disposed proximate a top of the reservoir for supplying ink to the reservoir; and an ink outlet disposed proximate a bottom side of the reservoir for supplying ink from the reservoir to the nozzle array;

a first valve disposed proximate the ink inlet of the printhead body;

a valve opening and closing mechanism for the first valve including:

an inflatable bag immersed in ink in the reservoir and having an opening to atmosphere; and a biasing mechanism tending to force air to exit the bag through the opening; and a filter disposed in the reservoir of the printhead body, wherein the filter is tilted relative to the nozzle face of the printhead die;

a replaceable ink tank including:

an ink chamber for storing a supply of ink;

a vent to atmosphere; and a tank outlet disposed proximate a bottom side of the ink tank;

a second valve disposed at the tank outlet; and an ink conduit for providing ink between the tank outlet and the ink inlet of the printhead body;

a media advance system for advancing recording medium toward a printing region;

a motor for moving the inkjet printhead and the replaceable ink tank across the printing region;

a maintenance station including a cap for isolating the nozzle face from ambient when the inkjet printhead is not printing; and a pressure source disposed near the maintenance station for providing air pressure to the opening of the inflatable bag.

13. An inkjet printer comprising:

an inkjet printhead assembly comprising:

an inkjet printhead including:

a nozzle array for ejecting ink drops, the nozzle array being disposed in a nozzle face of a printhead die;

a printhead body including:

a reservoir for ink;

an ink inlet disposed proximate a top of the reservoir for supplying ink to the reservoir; and an ink outlet disposed proximate a bottom side of the reservoir for supplying ink from the reservoir to the nozzle array;

a first valve disposed proximate the ink inlet of the printhead body;

a valve opening and closing mechanism for the first valve including:

an inflatable bag immersed in ink in the reservoir and having an opening to atmosphere; and a biasing mechanism tending to force air to exit the bag through the opening; and a filter disposed in the reservoir of the printhead body, wherein the filter is tilted relative to the nozzle face of the printhead die;

a replaceable ink tank including:

an ink chamber for storing a supply of ink;

a vent to atmosphere; and a tank outlet disposed proximate a bottom side of the ink tank;

a second valve disposed at the tank outlet; and an ink conduit for providing ink between the tank outlet and the ink inlet of the printhead body;

a media advance system for advancing recording medium toward a printing region;

a motor for moving the inkjet printhead and the replaceable ink tank across the printing region; and a maintenance station including a cap for isolating the nozzle face from ambient when the inkjet printhead is not printing;

the replaceable ink tank further including:

a pipe extending from a bottom side of the ink chamber toward a top side that is opposite the bottom side; and a third valve disposed near an end of the pipe proximate the bottom side of the ink chamber, wherein the inkjet printer further comprises a pump for applying suction to the end of the pipe for removing air from the ink chamber.

14. The inkjet printer of claim 12 further comprising a guide member for guiding the inkjet printhead assembly back and forth across the printing region.

15. The inkjet printer of claim 14, wherein the printhead body further includes a first guide retainer and a second guide retainer in line with the first guide retainer for guiding the inkjet printhead along the guide member as the inkjet printhead assembly moves back and forth across the printing region.

* * * * *